US011002182B2

(12) United States Patent
Maekawa et al.

(10) Patent No.: US 11,002,182 B2
(45) Date of Patent: May 11, 2021

(54) OUTBOARD MOTOR

(71) Applicant: YAMAHA HATSUDOKI KABUSHIKI KAISHA, Iwata (JP)

(72) Inventors: Shinya Maekawa, Iwata (JP); Norihito Tabata, Iwata (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 16/654,799

(22) Filed: Oct. 16, 2019

(65) Prior Publication Data

US 2020/0200076 A1 Jun. 25, 2020

(30) Foreign Application Priority Data

Dec. 20, 2018 (JP) ..... JP2018-237984

(51) Int. Cl.
*B63H 20/32* (2006.01)
*F02B 61/04* (2006.01)

(52) U.S. Cl.
CPC ..... *F02B 61/045* (2013.01); *B63H 20/32* (2013.01); *B63H 2020/323* (2013.01)

(58) Field of Classification Search
CPC .. F02B 61/045; B63H 20/32; B63H 2020/323
See application file for complete search history.

(56) References Cited

U.S. PATENT DOCUMENTS 5,910,191 A * 6/1999 Okamoto ..... F02B 61/045 74/473.14
6,041,892 A * 3/2000 Watanabe ..... F01M 1/02 123/196 W
6,102,755 A * 8/2000 Hoshiba ..... F02B 61/045 440/1
6,321,711 B1 * 11/2001 Kato ..... F02B 61/045 123/195 A
2004/0103884 A1 * 6/2004 Maejima ..... F02M 35/10216 123/456
2015/0367924 A1 * 12/2015 Davis ..... B63H 20/08 440/53
2016/0176491 A1 * 6/2016 Ito ..... F02M 61/16 123/468
2016/0186677 A1 * 6/2016 Achiwa ..... F02M 35/116 440/88 A
2020/0200076 A1 * 6/2020 Maekawa ..... F02M 35/116

FOREIGN PATENT DOCUMENTS

JP 2000-110686 A 4/2000

* cited by examiner

*Primary Examiner* — S. Joseph Morano
*Assistant Examiner* — Jovon E Hayes
(74) *Attorney, Agent, or Firm* — Global IP Counselors, LLP

(57) ABSTRACT

An intake manifold is connected to a cylinder head, and extends backward therefrom. An injector is attached to either the cylinder head or the intake manifold. At least one of the cylinder head and the intake manifold includes a curve pipe portion shaped to curve backward from a lateral surface of the cylinder head. An injector is attached to the cylinder head at either an outer lateral surface of the curve pipe portion in a right-and-left direction of an outboard motor or a position located forward of the curve pipe potion.

6 Claims, 14 Drawing Sheets

OUTBOARD MOTOR

BACKGROUND

Technical Field

The present invention generally relates to an outboard motor.

Background Information

An intake manifold is connected to an engine of an outboard motor. The intake manifold is connected to an intake port of a cylinder head of the engine. For example, Japan Laid-open Patent Application Publication No. 2000-110686 describes an outboard motor in which a pair of intake manifolds extends forward from a pair of cylinder heads of an engine, respectively, and is in part located in front of the engine. Additionally, a plurality of injectors are connected to each cylinder head. A head cover is also connected to each cylinder head. The injectors are attached to each cylinder head, while being disposed between an intake port of each cylinder head and a mating surface between each cylinder head and the head cover.

SUMMARY

As described above, when the outboard motor has the structure that the intake manifolds extend forward from the cylinder heads, respectively, the front part of the outboard motor is configured to have a large size. Incidentally, the outboard motor is attached to a vessel body of a watercraft, and the vessel body is disposed in front of the outboard motor. Because of this configuration, the front part of the outboard motor, when having a law size, is likely to interfere with the vessel body of the watercraft in tilting up the outboard motor.

By contrast, when the outboard motor has a structure that the intake manifolds extend backward from the cylinder heads, respectively, the front part of the outboard motor is configured to have a small size. Hence, the front part of the outboard motor can avoid interfering with the vessel body of the watercraft. In this case, however, each intake manifold is shaped to greatly curve backward and laterally outward so as to avoid interfering with the injectors. This results in increase in size of the outboard motor in a right-and-left direction.

One object of the present disclosure is to avoid interference between the front part of the outboard motor and the vessel body of the watercraft, and simultaneously, inhibit increase in size of the outboard motor in the right-and-left direction.

An outboard motor according to an aspect of the present disclosure includes an engine, a driveshaft, a propeller shaft, an intake manifold and an injector. The engine includes a crankcase, a crankshaft and a cylinder head. The crankshaft is at least in part disposed inside the crankcase. The cylinder head is disposed behind the crankcase. The driveshaft is connected to the crankshaft, and extends in an up-and-down direction of the outboard motor. The propeller shaft is connected to the driveshaft, and extends in a back-and-forth direction of the outboard motor. The intake manifold is connected to the cylinder head, and extends backward from the cylinder head. The injector is attached to either the cylinder head or the intake manifold. At least one of the cylinder head and the intake manifold includes a curve pipe portion. The curve pipe portion is shaped to curve backward from a lateral surface of the cylinder head. The injector is attached to the cylinder head at either an outer lateral surface of the curve pipe portion in the right-and-left direction of the outboard motor or a position located forward of the curve pipe portion.

In the outboard motor according to the present aspect, the intake manifold extends backward from the cylinder head. Because of this configuration, the outboard motor can be made more compact in size of a front part thereof than when the intake manifold extends forward from the cylinder head. Consequently; when tilted up, the outboard motor can avoid interfering at the front part thereof with a vessel body of the watercraft. Moreover, the injector is attached to the cylinder head at either the outer lateral surface of the curve pipe portion in the right-and-left direction of the outboard motor or the position located forward of the curve pipe portion. Therefore, the curve pipe portion can be disposed more adjacently to the cylinder head than when the right injector is attached to the inner lateral surface of the curve pipe portion. Consequently, increase in size of the outboard motor can be inhibited in the right-and-left direction.

DETAILED DESCRIPTION OF EMBODIMENTS

Figure 1:
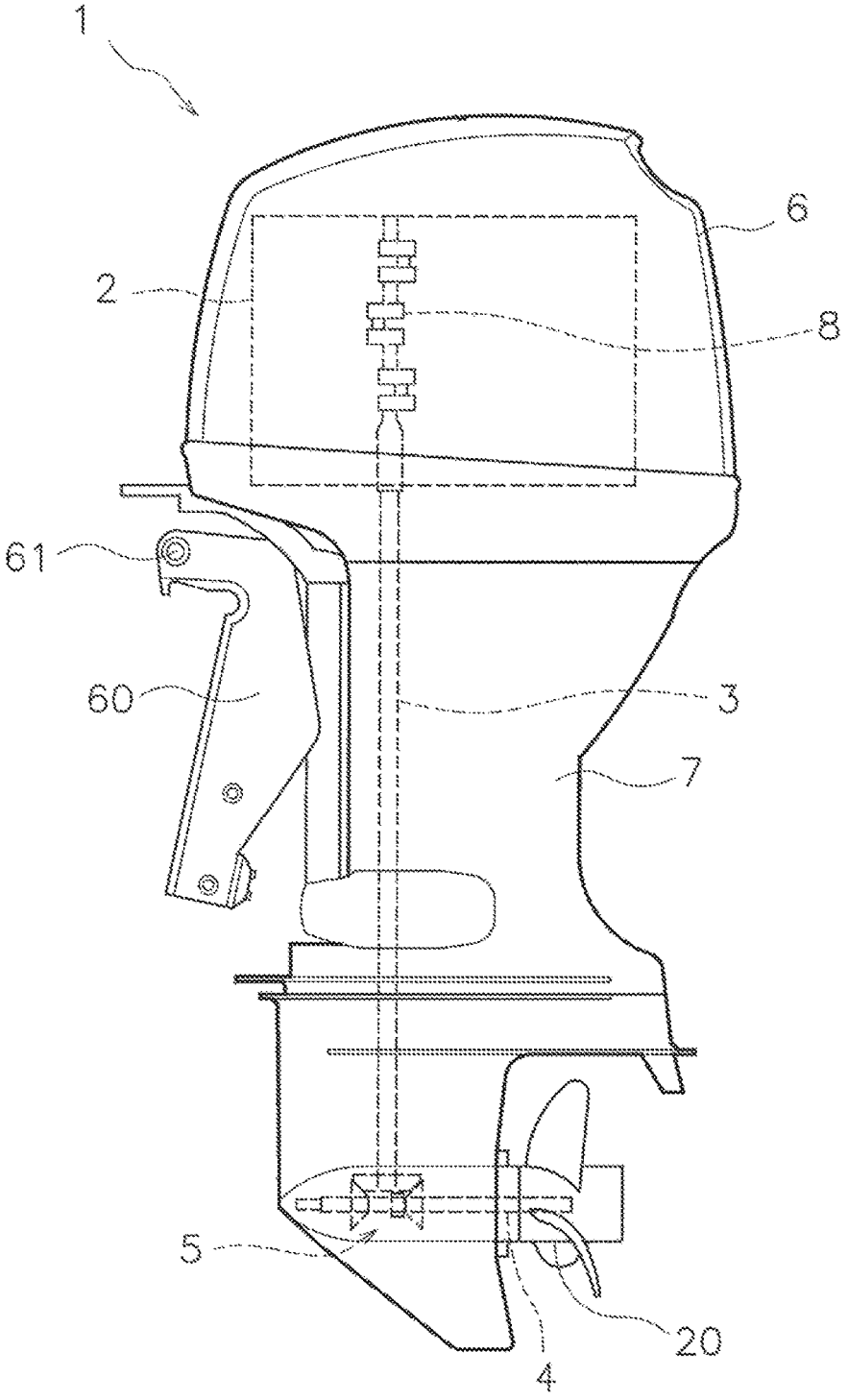
FIG. 1 is a side elevational view of an outboard motor according to an embodiment.

An embodiment will be hereinafter explained with reference to drawings. FIG. 1 is a side view of an outboard motor 1 according to the embodiment. As shown in FIG. 1, the outboard motor 1 includes an engine 2, a driveshaft 3, a propeller shaft 4, a shift mechanism 5, an engine cowl 6 and a housing 7. It should be noted that in the following explanation, front, rear, left, right, up and down directions are defined as meaning the front, rear, left, right, up and down directions of the outboard motor 1, respectively.

The engine 2 generates a thrust for propelling a watercraft. The engine 2 is disposed inside the engine cowl 6. The engine 2 includes a crankshaft 8. The crankshaft 8 extends in a vertical direction. The driveshaft 3 is connected to the crankshaft 8. The driveshaft 3 extends in an up-and-down direction. The propeller shaft 4 extends in a direction intersecting with the driveshaft 3. The propeller shaft 4 extends in a back-and-forth direction. The propeller shaft 4 is connected to the driveshaft 3 through the shift mechanism 5. A propeller 20 is connected to the propeller shaft 4.

The housing 7 is disposed directly below the engine cowl 6. The driveshaft 3 is disposed inside an upper part of the housing 7. The propeller shaft 4 and the shift mechanism 5 are disposed inside a lower part of the housing 7. The shift mechanism 5 switches the rotational direction of power to be transmitted from the driveshaft 3 to the propeller shaft 4. The shift mechanism 5 includes, for instance, a plurality of gears and a clutch that changes meshing of the gears.

The outboard motor 1 includes a bracket 60. The outboard motor 1 is attached to a vessel body of the watercraft through the bracket 60. The bracket 60 includes a trim and tilt shaft 61. The trim and tilt shaft 61 extends in a right-and-left direction of the outboard motor 1. The outboard motor 1 is supported by the bracket 60, while being rotatable about the trim and tilt shaft 61.

Figure 2:
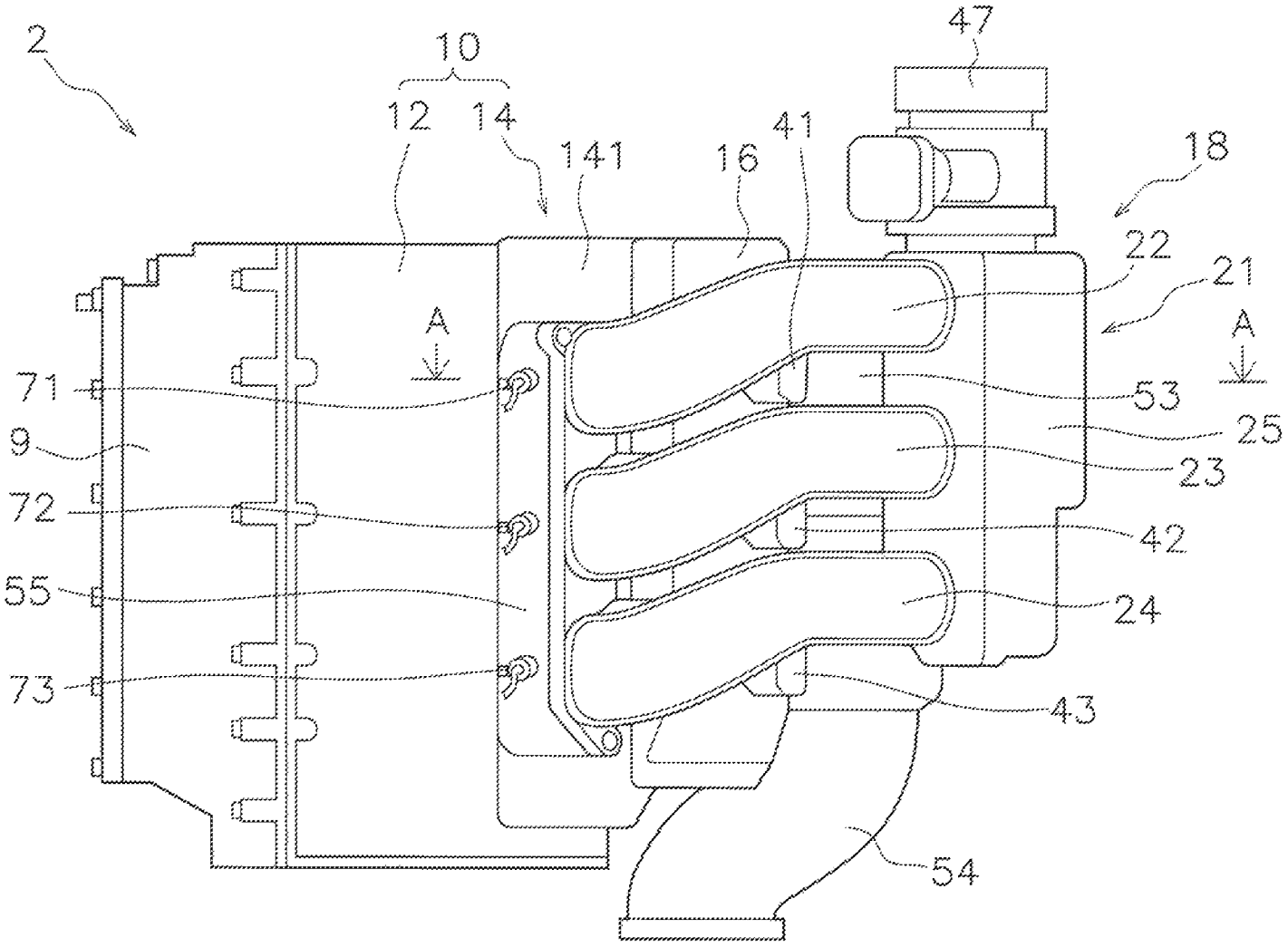
FIG. 2 is a left side elevational view of an engine for the outboard motor illustrated in FIG. 1.
Figure 3:
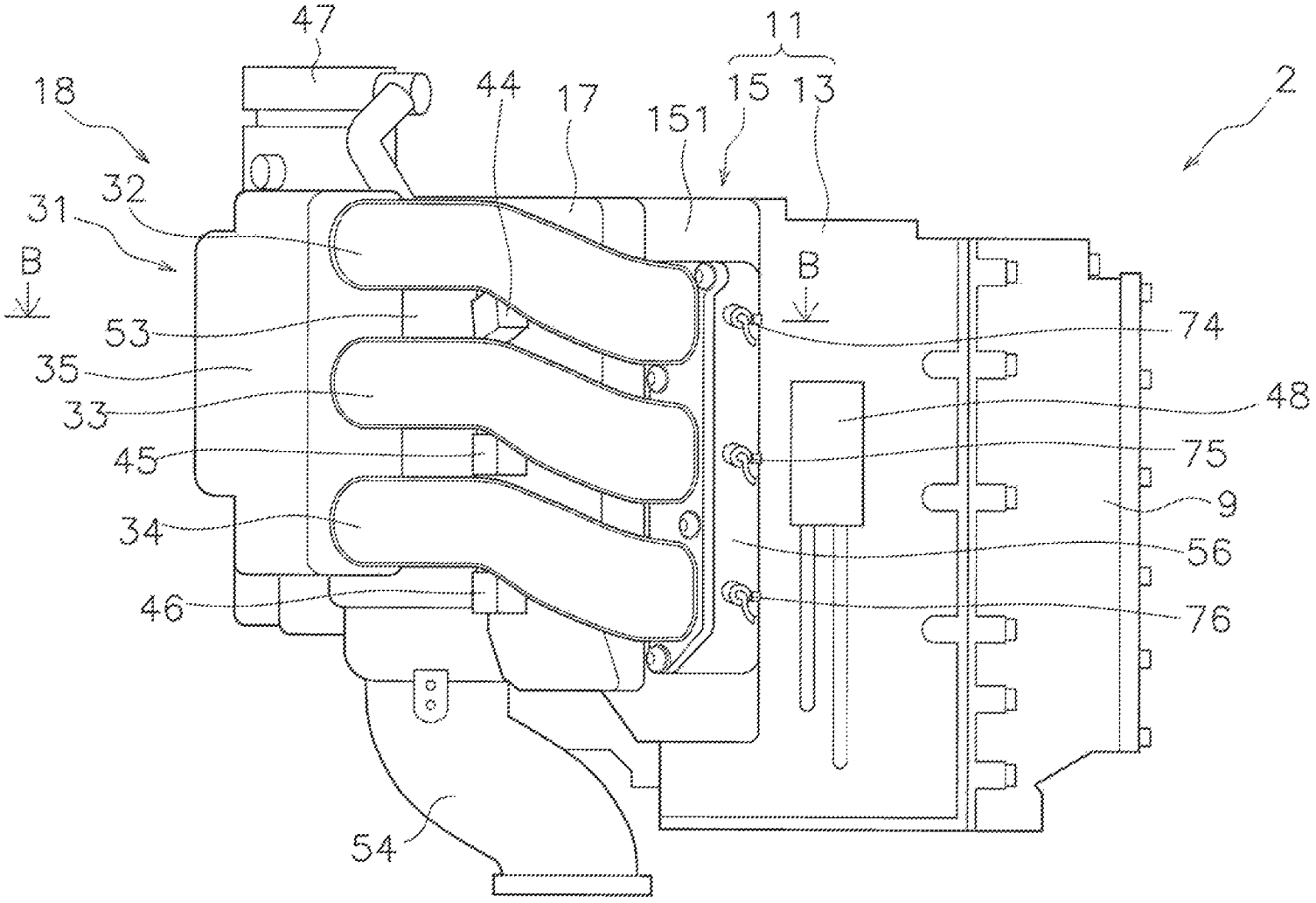
FIG. 3 is a right side elevational view of the engine illustrated in FIG. 2.
Figure 4:
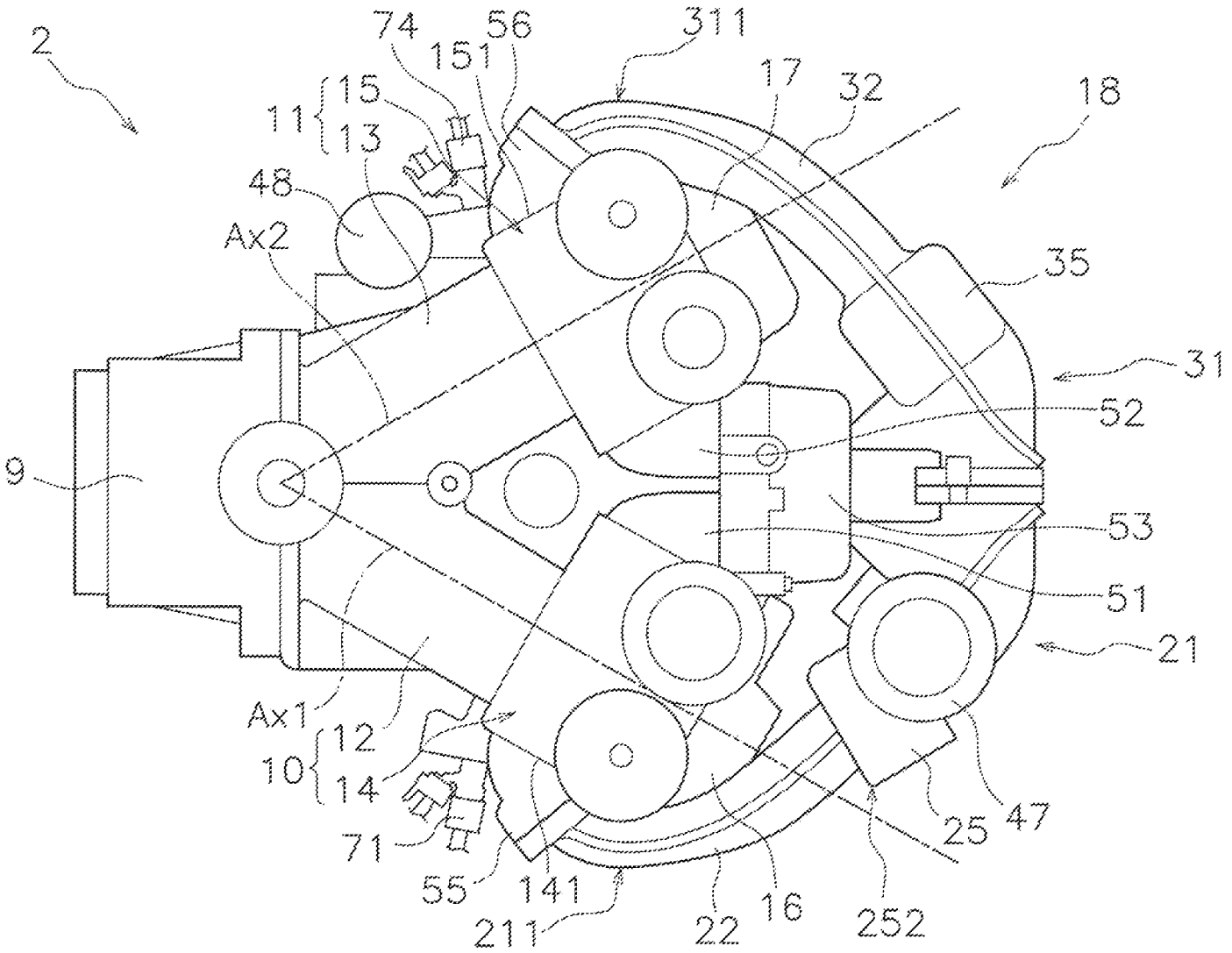
FIG. 4 is a top view of the engine illustrated in FIGS. 2 and 3.
Figure 5:
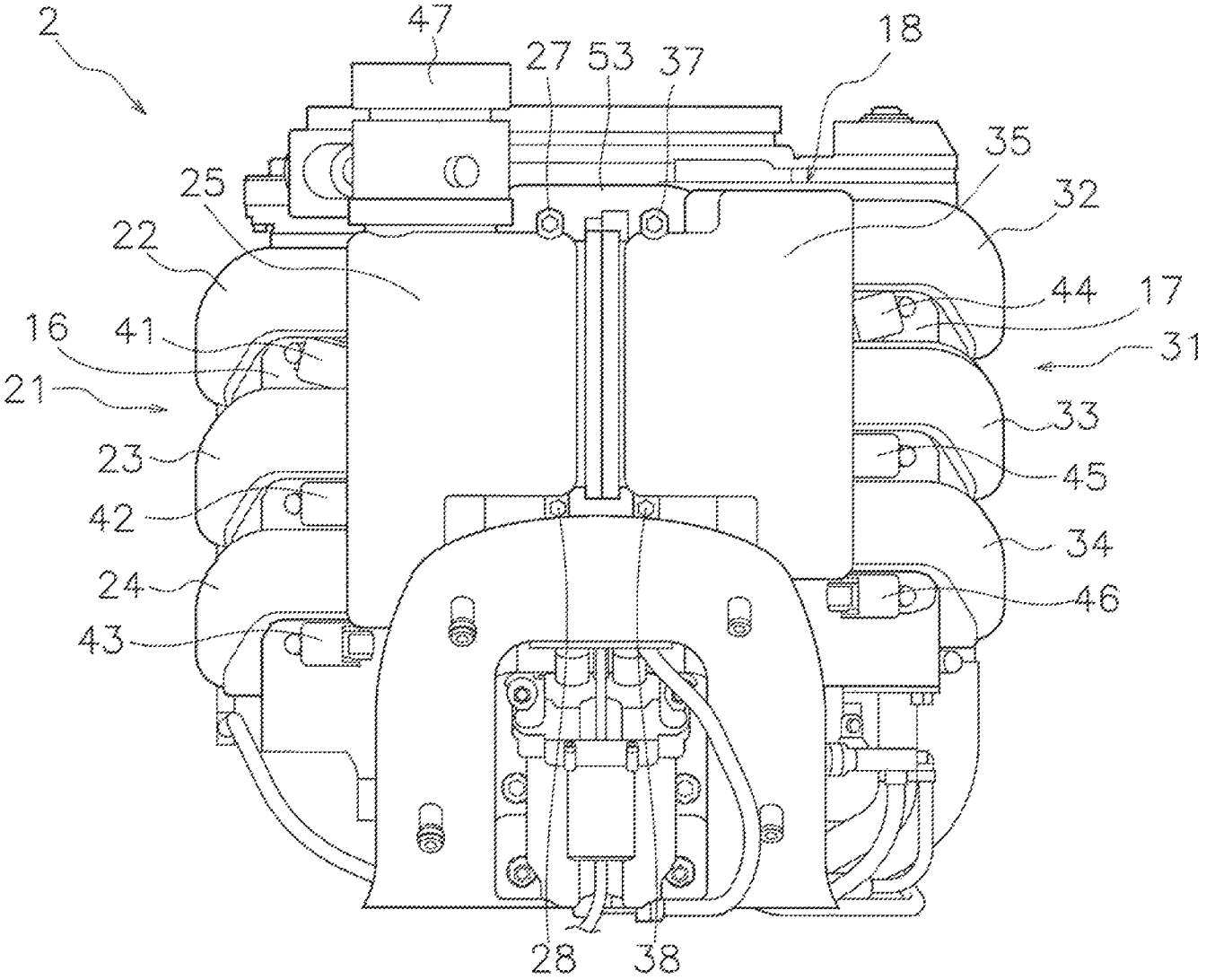
FIG. 5 is a rear view of the engine illustrated in FIGS. 2 to 4.

FIG. 2 is a left side elevational view of the engine 2. FIG. 3 is a right side elevational view of the engine 2 illustrated in FIG. 2. FIG. 4 is a top view of the engine 2 illustrated in FIGS. 2 and 3. FIG. 5 is a mar view of the engine 2 illustrated in FIGS. 2 to 4. As shown in FIGS. 2 to 4, the engine 2 includes a crankcase 9, a left cylinder 10, a right cylinder 11, a left head cover 16 and a right head cover 17. The crankcase 9 accommodates at least part of the crankshaft 8 described above.

The left and right cylinders 10 and 11 are disposed behind the crankcase 9. The left and right cylinders 10 and 11 are disposed in left and right alignment. The left and right cylinders 10 and 11 are disposed to tilt with respect to the back-and-forth direction such that an interval therebetween is widened backward. The left cylinder 10 includes a cylinder axis Ax1 extending backward and leftward. The right cylinder 11 includes a cylinder axis Ax2 extending backward and rightward. The engine 2 is a so-called V engine.

The left cylinder 10 includes a left cylinder body 12 and a left cylinder head 14. The right cylinder 11 includes a right cylinder body 13 and a right cylinder head 15. The left and right cylinder bodies 12 and 13 are disposed behind the crankcase 9. The left and right cylinder bodies 12 and 13 are disposed in left and right alignment. The left and right cylinder bodies 12 and 13 are connected to the crankcase 9.

The left cylinder head 14 is disposed behind the left cylinder body 12. The right cylinder head 15 is disposed behind the right cylinder body 13. The left cylinder head 14 is connected to the left cylinder body 12. The right cylinder head 15 is connected to the right cylinder body 13. The left and right cylinder heads 14 and 15 are disposed in left and right alignment. The left and right cylinder heads 14 and 15 are disposed to tilt with respect to the back-and-forth direction such that an interval therebetween is widened backward.

It should be noted that the left and right cylinder bodies 12 and 13 can be separated from the crankcase 9, or alternatively, can be integrated with the crankcase 9. The left cylinder body 12 can be separated from the left cylinder head 14, or alternatively, can be integrated with the left cylinder head 14. The right cylinder body 13 can be separated from the right cylinder head 15, or alternatively, can be integrated with the right cylinder head 15. The left and right cylinder bodies 12 and 13 can be integrated with each other, or alternatively, can be separated from each other.

The left head cover 16 is disposed behind the left cylinder head 14. The left head cover 16 is attached to the left cylinder head 14. The right head cover 17 is disposed behind the right cylinder head 15. The right head cover 17 is attached to the right cylinder head 15.

Figure 6:
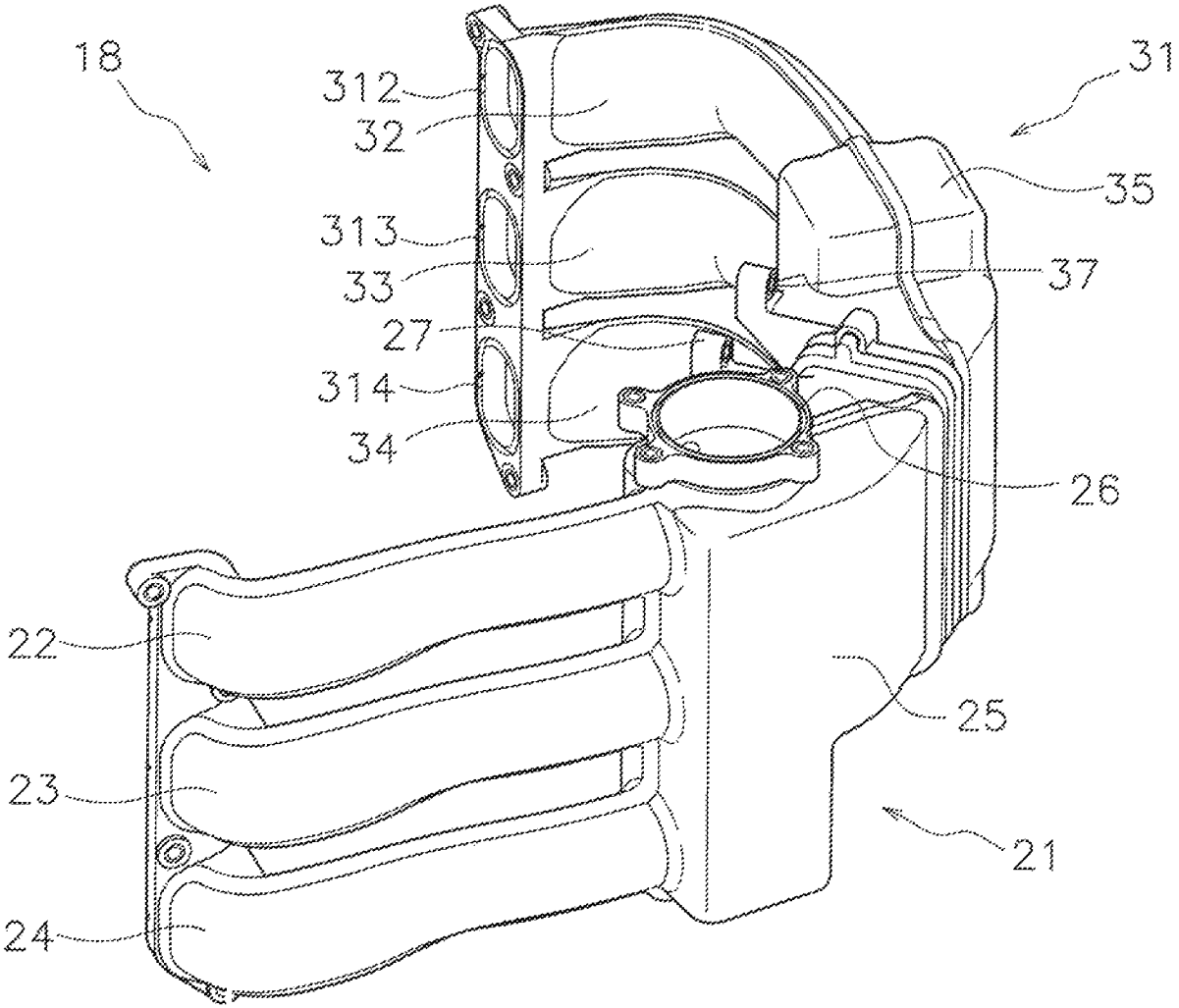
FIG. 6 is a perspective view of an intake manifold for the engine illustrated in FIGS. 2 to 5.

The outboard motor 1 includes an intake manifold 18. FIG. 6 is a perspective view of the intake manifold 18. As shown in FIGS. 2 to 6, the intake manifold 18 is connected to the left and right cylinder heads 14 and 15. The intake manifold 18 is disposed behind the left and right cylinder heads 14 and 15. The intake manifold 18 includes a left intake manifold 21 and a right intake manifold 31. The left and right intake manifolds 21 and 31 are separated from each other. However, the left and right intake manifolds 21 and 31 can be integrated with each other.

The left intake manifold 21 is attached to the left cylinder head 14. The left intake manifold 21 is connected to an outer lateral surface 141 of the left cylinder head 14. The outer lateral surface 141 of the left cylinder head 14 is the left lateral surface of the left cylinder head 14. Specifically, the left cylinder head 14 is provided with a left curve pipe portion 55 on the outer lateral surface 141 thereof. The left curve pipe portion 55 is communicated with an intake port provided inside the left cylinder head 14. The left curve pipe portion 55 protrudes laterally outward from the outer lateral surface 141 of the left cylinder head 14. The left curve pipe portion 55 is shaped to curve backward from the outer lateral surface 141 of the left cylinder head 14.

The left intake manifold 21 extends backward through the left side of the left cylinder head 14. The left intake manifold 21 is disposed backward of the crankcase 9. As seen in a side view, the left intake manifold 21 does not overlap with the crankcase 9. The left intake manifold 21 is disposed backward of the left cylinder body 12. As seen in the side view, the left intake manifold 21 does not overlap with the left cylinder body 12.

The right intake manifold 31 is attached to the right cylinder head 15. The right intake manifold 31 is connected to an outer lateral surface 151 of the right cylinder head 15. The outer lateral surface 151 of the right cylinder head 15 is the right lateral surface of the right cylinder head 15. Specifically, the right cylinder head 15 is provided with a right curve pipe portion 56 on the outer lateral surface 151 thereof. The right curve pipe portion 56 is communicated with an intake port provided inside the right cylinder head 15. The right curve pipe portion 56 protrudes laterally outward from the outer lateral surface 151 of the right cylinder head 15. The right curve pipe portion 56 is shaped to curve backward from the outer lateral surface 151 of the right cylinder head 15.

The right intake manifold 31 extends backward through the right side of the right cylinder head 15. The right intake manifold 31 is disposed backward of the crankcase 9. As seen in a side view, the right intake manifold 31 does not overlap with the crankcase 9. The right intake manifold 31 is disposed backward of the right cylinder body 13. As seen in the side view, the right intake manifold 31 does not overlap with the right cylinder body 13.

Figure 7:
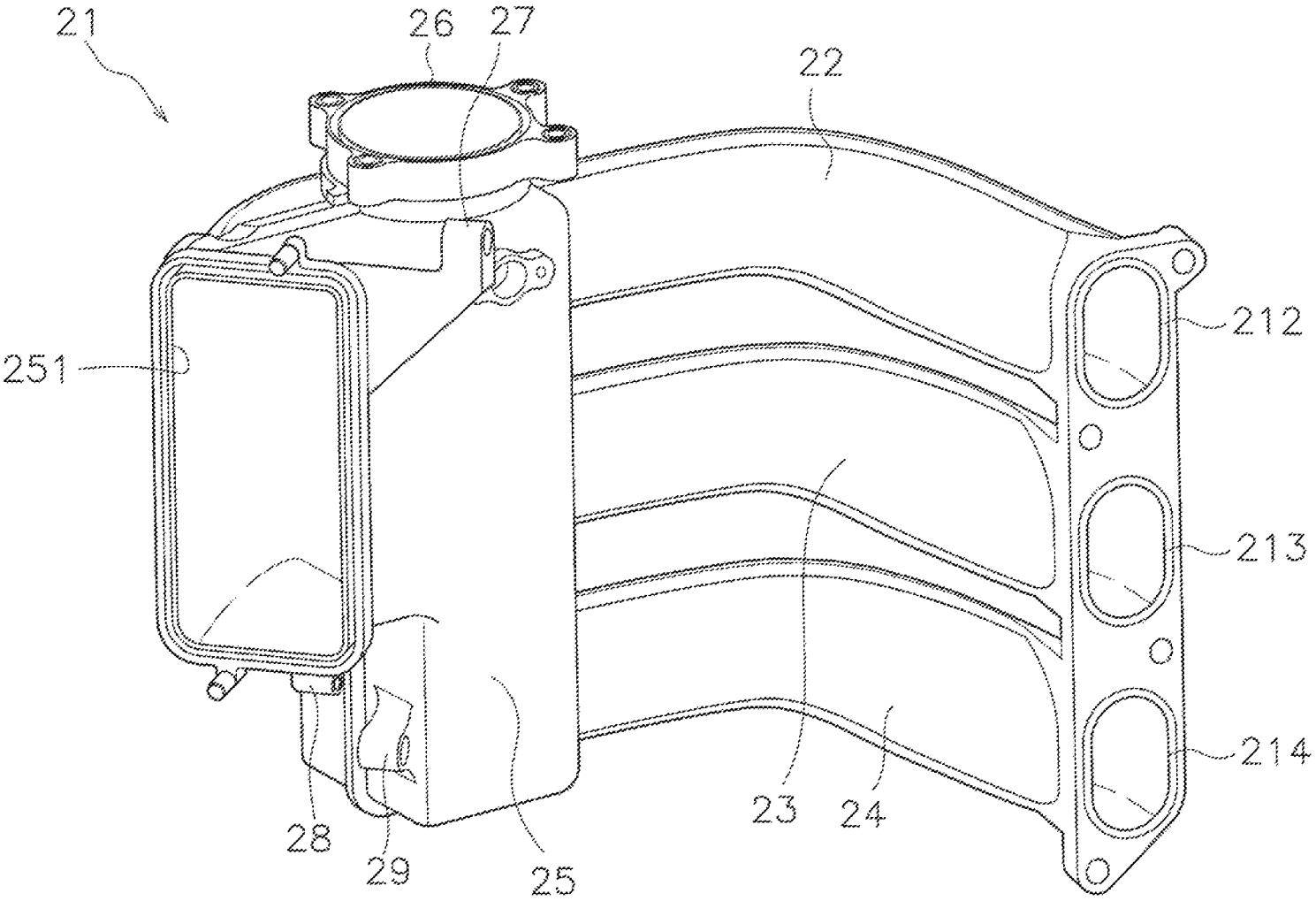
FIG. 7 is a perspective view of a left intake manifold for the engine illustrated in FIGS. 2 to 5.

FIG. 7 is a perspective view of the left intake manifold 21. As shown in FIG. 7, the left intake manifold 21 includes a plurality of left intake pipes 22 to 24 and a left pipe merge collector 25. The left intake pipes 22 to 24 are disposed in alignment in the up-and-down direction. As shown in FIG. 2, the left intake pipes 22 to 24 are connected to the outer lateral surface 141 of the left cylinder head 14. The left intake pipes 22 to 24 extend backward from the left cylinder head 14. As shown in FIG. 4, the left intake pipes 22 to 24 are shaped to extend through the left side of the left cylinder head 14 and then curve laterally inward in a position behind the left head cover 16.

The left intake pipe 22 includes a left connection port 212. The left intake pipe 23 includes a left connection port 213. The left intake pipe 24 includes a left connection port 214. The left connection ports 212 to 214 are connected to the left curve pipe portion 55. The left connection ports 212 to 214 are integrated with each other. However, the left connection ports 212 to 214 can be separated from each other.

As seen in the rear view shown in FIG. 5, the left intake pipes 22 to 24 overlap with the left head cover 16. The left intake pipes 22 to 24 are disposed at intervals in the up-and-down direction. As seen in the rear view, ignition coils 41 to 43 are disposed in alternate alignment with the left intake pipes 22 to 24. It should be noted that in the present embodiment, the left intake manifold 21 includes three of the left intake pipes 22 to 24. However, the number of the left intake pipes 22 to 24 is not limited to three, and alternatively, can be less than or greater than three.

The left pipe merge collector 25 is connected to the left intake pipes 22 to 24. The left pipe merge collector 25 extends in the up-and-down direction. The left pipe merge collector 25 is disposed behind the left head cover 16. As seen in the rear view the left pipe merge collector 25 overlaps with the left head cover 16. The left intake pipes 22 to 24 are connected to the left lateral surface of the left pipe merge collector 25. The left pipe merge collector 25 includes a left connection opening 251. The left connection opening 251 is provided in the right lateral surface of the left pipe merge collector 25.

Figure 8:
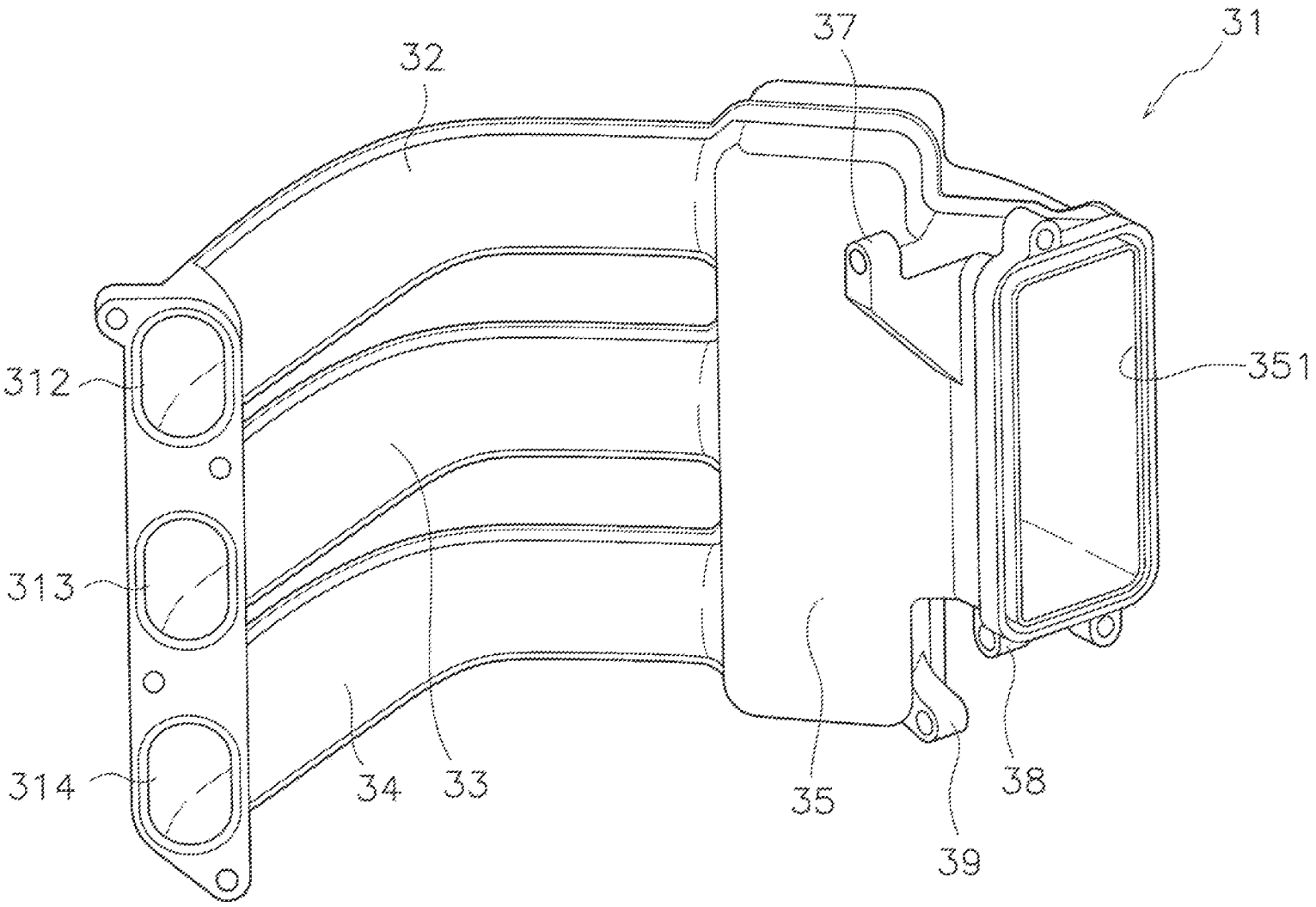
FIG. 8 is a perspective view of a right intake manifold for the engine illustrated in FIGS. 2 to 5.

FIG. 8 is a perspective view of the right intake manifold 31. As shown in FIG. 8, the right intake manifold 31 includes a plurality of right intake pipes 32 to 34 and a right pipe merge collector 35. The right intake pipes 32 to 34 are disposed in alignment in the up-and-down direction. As shown in FIG. 3, the right intake pipes 32 to 34 are connected to the outer lateral surface 151 of the tight cylinder head 15. The right intake pipes 32 to 34 extend backward from the right cylinder head 15. As shown in FIG. 4, the right intake pipes 32 to 34 are shaped to extend through the right side of the right cylinder head 15 and then curve laterally inward in a position behind the right head cover 17.

The tight intake pipe 32 includes a right connection port 312. The right intake pipe 33 includes a right connection port 313. The right intake pipe 34 includes a right connection port 314. The right connection ports 312 to 314 are connected to the right curve pipe portion 56. The right connection ports 312 to 314 are integrated with each other. However, the right connection ports 312 to 314 can be separated from each other.

As seen in the rear view shown in FIG. 5, the right intake pipes 32 to 34 overlap with the right head cover 17. The right intake pipes 32 to 34 are disposed at intervals in the up-and-down direction. As seen in the rear view, ignition coils 44 to 46 are disposed in alternate alignment with the tight intake pipes 32 to 34. It should be noted that in the present embodiment, the tight intake manifold 31 includes three of the right intake pipes 32 to 34. However, the number of the right intake pipes 32 to 34 is not limited to three, and alternatively, can be less than or greater than three.

The right pipe merge collector 35 is connected to the right intake pipes 32 to 34. The right pipe merge collector 35 extends in the up-and-down direction. The right pipe merge collector 35 is disposed behind the right head cover 17. As seen in the rear view, the right pipe merge collector 35 overlaps with the right head cover 17. The right intake pipes 32 to 34 are connected to the right lateral surface of the right pipe merge collector 35. The right pipe merge collector 35 includes a right connection opening 351. The right connection opening 351 is provided in the left lateral surface of the right pipe merge collector 35.

The left and right connection openings 251 and 351 are connected to each other. The left and right connection openings 251 and 351 are disposed behind a V-shaped space produced between the left and right cylinder heads 14 and 15. In other words, the left and right intake manifolds 21 and 31 are connected to each other in a position behind the V-shaped space produced between the left and right cylinder heads 14 and 15.

As shown in FIG. 4, the outboard motor 1 includes a plurality of left exhaust pipes 51, a plurality of right exhaust pipes 52 and an exhaust pipe 53. It should be noted that FIG. 4 only shows the uppermost one of the left exhaust pipes 51 and that of the right exhaust pipes 52. The left exhaust pipes 51 and the right exhaust pipes 52 are disposed in the V-shaped space produced between the left and right cylinder heads 14 and 15. The left exhaust pipes 51 are connected to the inner lateral surface of the left cylinder head 14, and extends backward from the left cylinder head 14. The right exhaust pipes 52 are connected to the inner lateral surface of the right cylinder head 15, and extends backward from the right cylinder head 15.

The exhaust pipe 53 includes a catalytic converter that contains a catalyst such as a three-way catalyst, and purifies exhaust gas transferred thereto from the engine 2. The exhaust pipe 53 extends in the up-and-down direction. The exhaust pipe 53 is connected to the left exhaust pipes 51 and the right exhaust pipes 52. The exhaust pipe 53 is disposed behind the left exhaust pipes 51 and the right exhaust pipes 52. The exhaust pipe 53 is disposed in front of the left pipe merge collector 25 of the left intake manifold 21 and the right pipe merge collector 35 of the right intake manifold 31. The exhaust pipe 53 is disposed in the V-shaped space produced between the left and right cylinder heads 14 and 15. As seen in the rear view, the exhaust pipe 53 overlaps with the left pipe merge collector 25 of the left intake manifold 21 and the right pipe merge collector 35 of the right intake manifold 31. An exhaust pipe 54 is connected to a lower part of the exhaust pipe 53. The exhaust pipe 54 extends downward from the exhaust pipe 53.

As shown in FIG. 7, the left intake manifold 21 includes a plurality of left fixation portions 27 to 29. The left intake manifold 21 is fixed at the left fixation portions 27 to 29 to the exhaust pipe 53. The left fixation portions 27 to 29 are provided on the left pipe merge collector 25. As shown in FIG. 8, the right intake manifold 31 includes a plurality of right fixation portions 37 to 39. The tight intake manifold 31 is fixed at the right fixation portions 37 to 39 to the exhaust pipe 53. The right fixation portions 37 to 39 are provided on the right pipe merge collector 35.

The outboard motor 1 includes a throttle body 47. The throttle body 47 is attached to the intake manifold 18. The throttle body 47 is attached to the left intake manifold 21. The throttle body 47 regulates the amount of air to be supplied to the intake manifold 18. As shown in FIG. 6, the left intake manifold 21 includes an attachment portion 26 of the intake manifold 18. The attachment portion 26 is provided on the left pipe merge collector 25 of the left intake manifold 21. Specifically, the attachment portion 26 is provided on the upper surface of the left pipe merge collector 25. The attachment portion 26 is opened upward. The throttle body 47 is attached to the attachment portion 26.

The outboard motor 1 includes an oil filter 48. The oil filter 48 is disposed outside the right lateral surface of the right cylinder body 13 in the right-and-left direction. The oil filter 48 is disposed forward of the right intake manifold 31. As seen in the side view, the oil filter 48 does not overlap with the right intake manifold 31.

As shown in FIG. 2, the outboard motor 1 includes a plurality of left injectors 71 to 73. The left injectors 71 to 73 are attached to the left cylinder head 14. The left injectors 71 to 73 inject fuel to the intake port inside the left cylinder head 14. Specifically, the left injectors 71 to 73 are attached to the outer lateral surface of the left curve pipe portion 55 in the right-and-left direction of the outboard motor 1, i.e., the left lateral surface of the left curve pipe portion 55. The left injectors 71 to 73 are disposed in alignment in the up-and-down direction.

As seen in the plan view of the outboard motor 1 shown in FIG. 4, the left injector 71 is located inward of an outer lateral end 211 of the left intake manifold 21 in the right-and-left direction of the outboard motor 1. In other words, as seen in the plan view of the outboard motor 1, the left injectors 71 to 73 do not protrude outward across the outer lateral end 211 of the left intake manifold 21. The other left injectors 72 and 73 are disposed similarly to the left injector 71, although illustration thereof is herein omitted.

As shown in FIG. 3, the outboard motor 1 includes a plurality of right injectors 74 to 76. The right injectors 74 to 76 are attached to the right cylinder head 15. The right injectors 74 to 76 inject the fuel to the intake port inside the right cylinder heal 15. Specifically, the right injectors 74 to 76 are attached to the outer lateral surface of the right curve pipe portion 56 in the right-and-left direction of the outboard motor 1, i.e., the right lateral surface of the right curve pipe portion 56. The right injectors 74 to 76 are disposed in alignment in the up-and-down direction.

As seen in the plan view of the outboard motor 1 shown in FIG. 4, the right injector 74 is located inward of an outer lateral end 311 of the right intake manifold 31 in the right-and-left direction of the outboard motor 1. In other words, as seen in the plan view of the outboard motor 1, the right injector 74 does not protrude outward across the outer lateral end 311 of the right intake manifold 31. The other right injectors 75 and 76 are disposed similarly to the right injector 74, although illustration thereof is herein omitted.

It should be noted that in the present embodiment, the outboard motor 1 includes three of the left injectors 71 to 73 and three of the right injectors 74 to 76. However, the number of the left injectors is not limited to three, and alternatively, can be less than or greater than three. The number of the right injectors is not limited to three, and alternatively, can be less than or greater than three.

Figure 9:
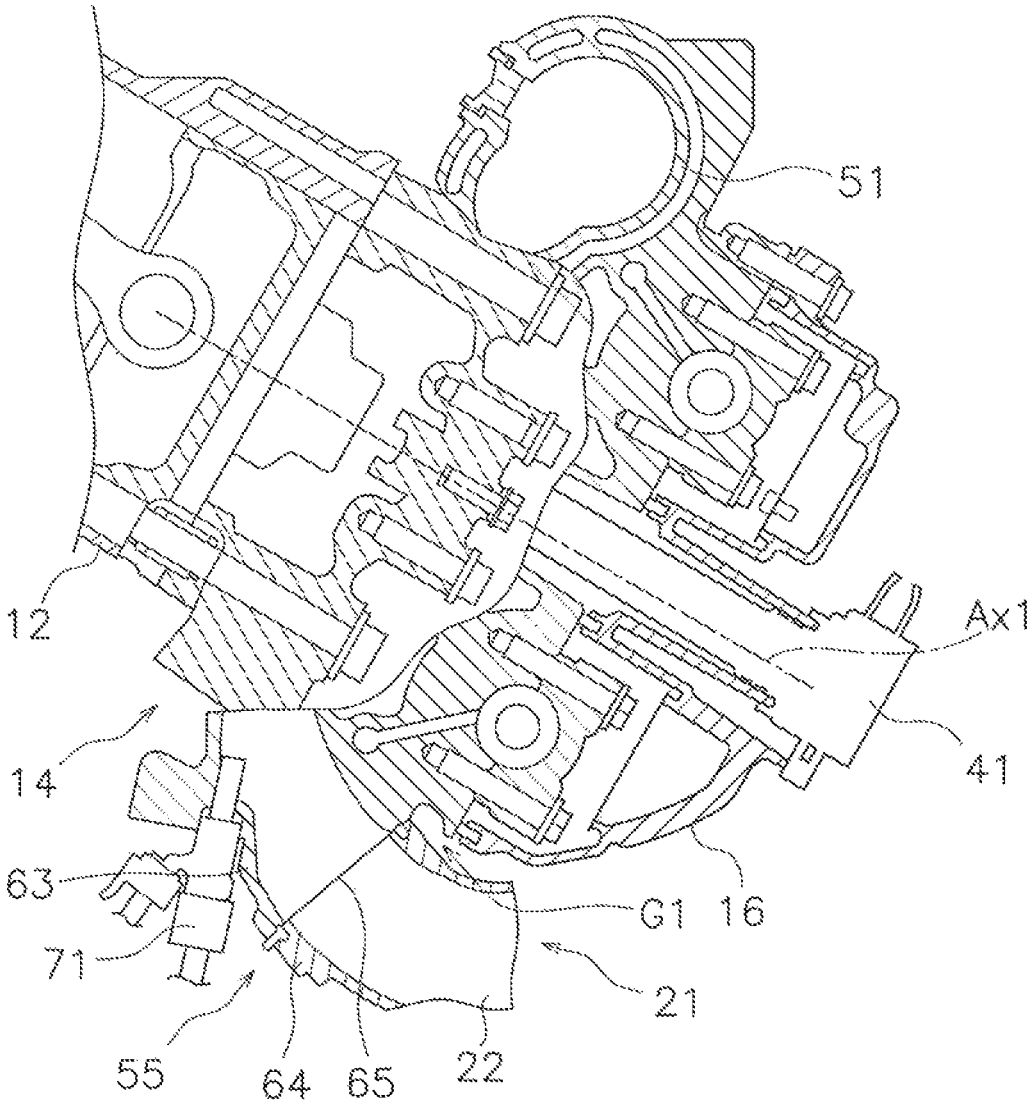
FIG. 9 is a partial cross sectional view of the engine taken along section line A-A in FIG. 2.

FIG. 9 is a partial view of a cross section taken along line A-A in FIG. 2. As shown in FIG. 9, the left curve pipe portion 55 includes a first pipe portion 63 and a second pipe portion 64. The first pipe portion 63 is included in the left cylinder head 14, whereas the second pipe portion 64 is included in the left intake manifold 21. The left injector 71 is located forward of a mating surface 65 between the first and second pipe portions 63 and 64. The left injector 71 is attached, at the first pipe portion 63, to the outer lateral surface of the left curve pipe portion 55. The inner lateral surface of the left curve pipe portion 55 is disposed adjacently to the left cylinder head 14 and the left head cover 16. A gap G1, produced between the inner lateral surface of the left curve pipe portion 55 and the left cylinder head 14 is smaller than the left injector 71. It should be noted that the other left injectors 72 and 73 are disposed similarly to the left injector 71.

Figure 10:
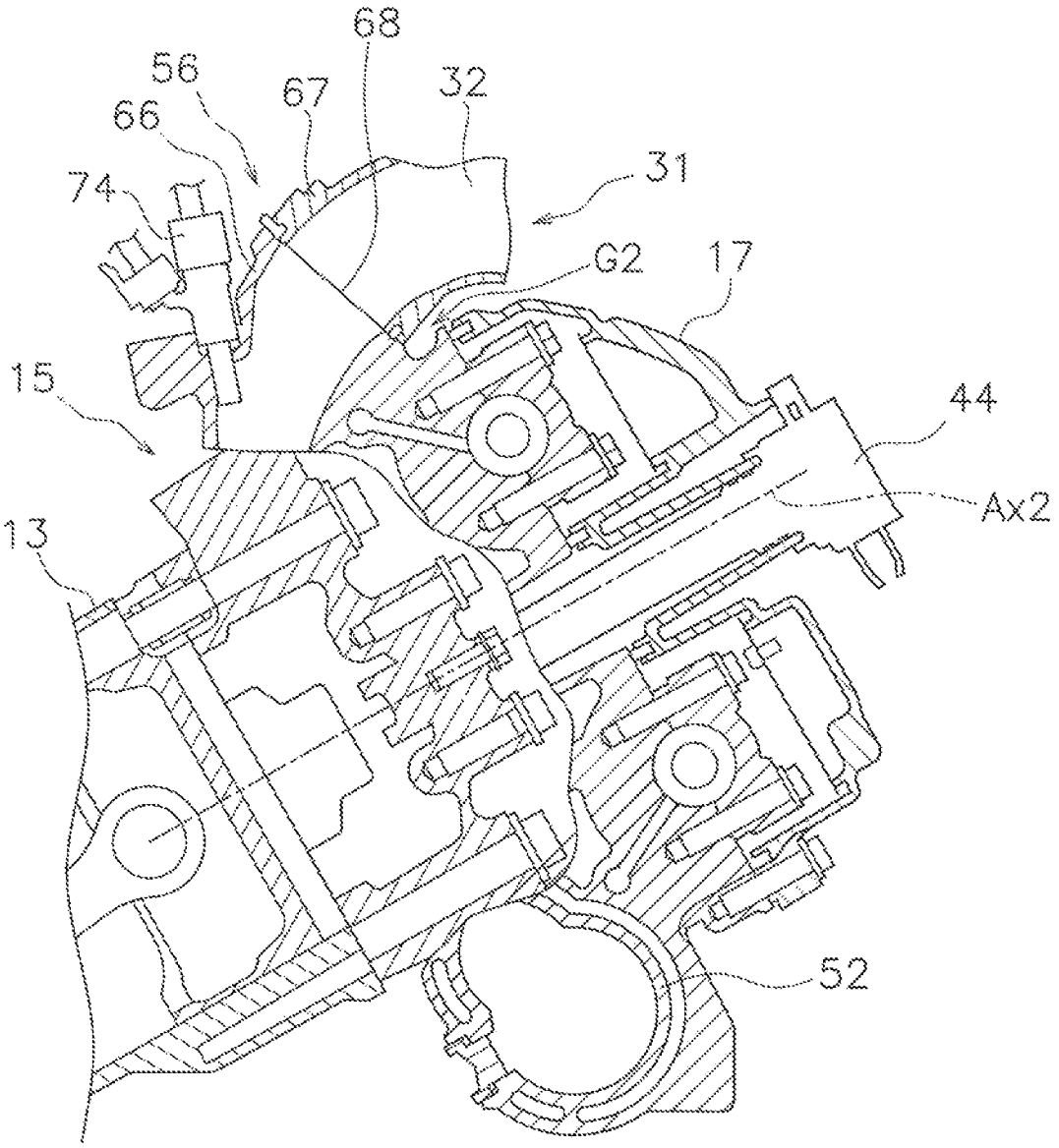
FIG. 10 is a partial cross sectional view of the engine taken along section B-B in FIG. 3.

FIG. 10 is a partial view of a cross section taken along line B-B in FIG. 3. As shown in FIG. 10, the right curve pipe portion 56 includes a first pipe portion 66 and a second pipe portion 67. The first pipe portion 66 is included in the right cylinder head 15, whereas the second pipe portion 67 is included in the right intake manifold 31. The right injector 74 is located forward of a mating surface 68 between the first and second pipe portions 66 and 67. The right injector 74 is attached, at the first pipe portion 66, to the outer lateral surface of the right curve pipe portion 56. The inner lateral surface of the right curve pipe portion 56 is disposed adjacently to the right cylinder head 15 and the right head cover 17. A gap G2, produced between the inner lateral surface of the right curve pipe portion 56 and the right cylinder head 15, is smaller than the right injector 74. It should be noted that the other right injectors 75 and 76 are disposed similarly to the right injector 74.

In the outboard motor 1 according to the present embodiment explained above, the left intake manifold 21 extends backward from the left cylinder head 14. Because of this, the outboard motor 1 can be made more compact in size of the front part thereof than when the left intake manifold 21 extends forward from the left cylinder head 14. Likewise, the right intake manifold 31 extends backward from the right cylinder head 15. Because of this, the outboard motor 1 can be made more compact in size of the front part thereof than when the right intake manifold 31 extends forward from the right cylinder head 15. Consequently, when tilted up, the outboard motor 1 can avoid interfering at the front part thereof with the vessel body of the watercraft.

Moreover, the left injectors 71 to 73 are attached to the outer lateral surface of the left curve pipe portion 55 in the right-and-left direction of the outboard motor 1. Therefore, the left curve pipe portion 55 can be disposed more adjacently to the left cylinder head 14 than when the left injectors 71 to 73 are attached to the inner lateral surface of the left curve pipe portion 55. In other words, the gap G1, produced between the inner lateral surface of the left curve pipe portion 55 and the left cylinder head 14, can be made smaller. The right injectors 74 to 76 are attached to the outer lateral surface of the right curve pipe portion 56 in the right-and-left direction of the outboard motor 1. Therefore, the right curve pipe portion 56 can be disposed more adjacently to the right cylinder head 15 than when the right injectors 74 to 76 are attached to the inner lateral surface of the right curve pipe portion 56. In other words, the gap G2, produced between the inner lateral surface of the right curve pipe portion 56 and the right cylinder head 15, can be made smaller. Consequently, increase in size of the outboard motor 1 can be inhibited in the right-and-left direction.

As seen in the plan view of the outboard motor 1, the left injectors 71 to 73 are located inward of the outer lateral end 211 of the left intake manifold 21 in the right-and-left direction of the outboard motor 1. As seen in the plan view of the outboard motor 1, the right injectors 74 to 76 are located inward of the outer lateral end 311 of the right intake manifold 31 in the right-and-left direction of the outboard motor 1. Because of the above, the left injectors 71 to 73 and the right injectors 74 to 76 can be disposed compactly in the right-and-left direction of the outboard motor 1. Consequently increase in size of the outboard motor 1 can be inhibited in the right-and-left direction.

One embodiment of the present invention has been explained above. However, the present invention is not limited to the aforementioned embodiment, and a variety of changes can be made without departing from the gist of the present invention.

The configuration of the outboard motor 1 is not limited to that of the aforementioned embodiment, and can be changed. The configuration of the engine 2 is not limited to that of the aforementioned embodiment, and can be changed. For example, the engine 2 is not limited to the V engine, and can be another type of engine such as an inline engine. In this case, either the left intake manifold 21 or the right intake manifold 31 can be omitted. Either the left injectors 71 to 73 or the right injectors 74 to 76 can be omitted.

The layout of the throttle body 47 is not limited to that of the aforementioned embodiment, and can be changed. For example, the throttle body 47 can be attached to the right intake manifold 31. The position, to which the throttle body 47 is attached, is not limited to the upper surface of the intake manifold 18, and can be any other suitable position.

Figure 11:
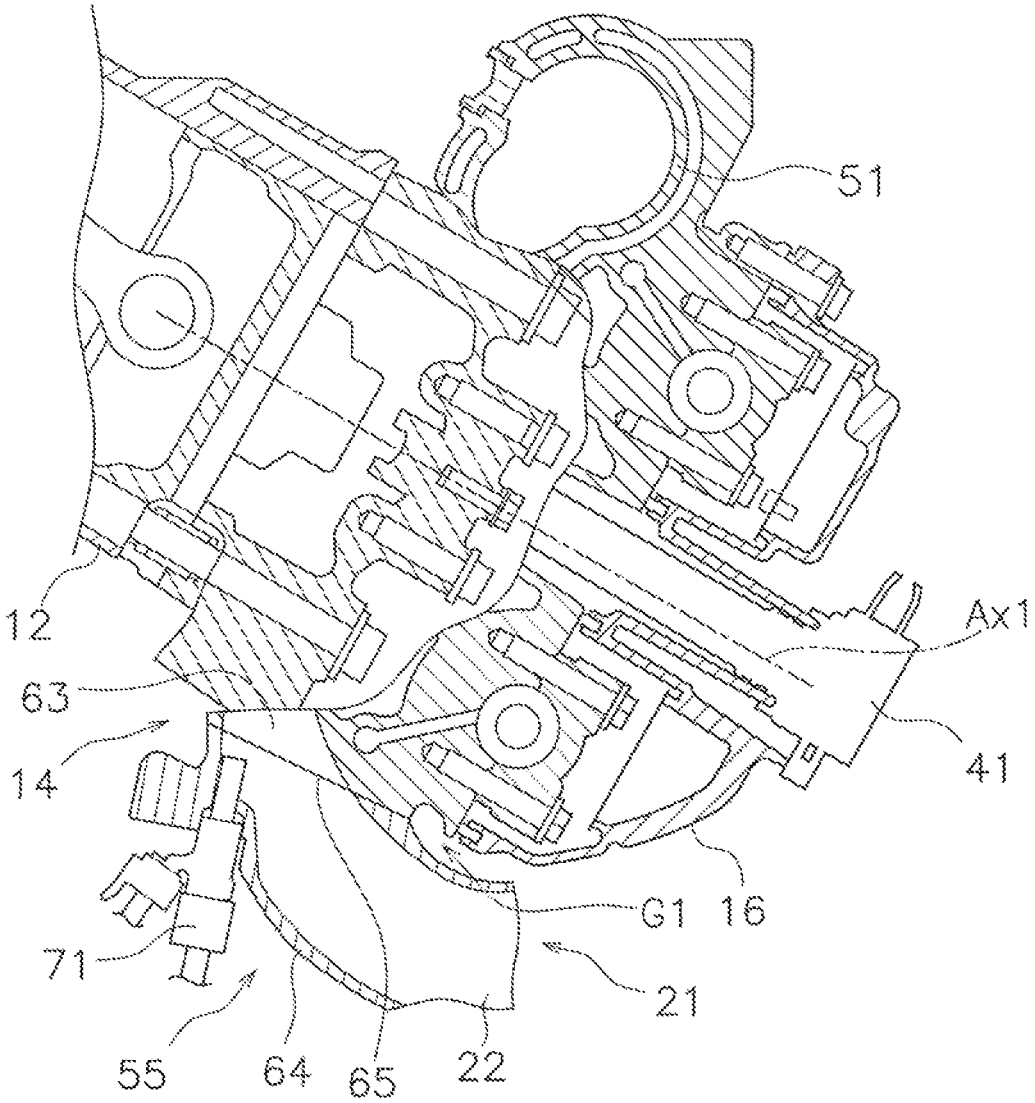
FIG. 11 is a cross-sectional view of a layout of injectors according to another embodiment.
Figure 12:
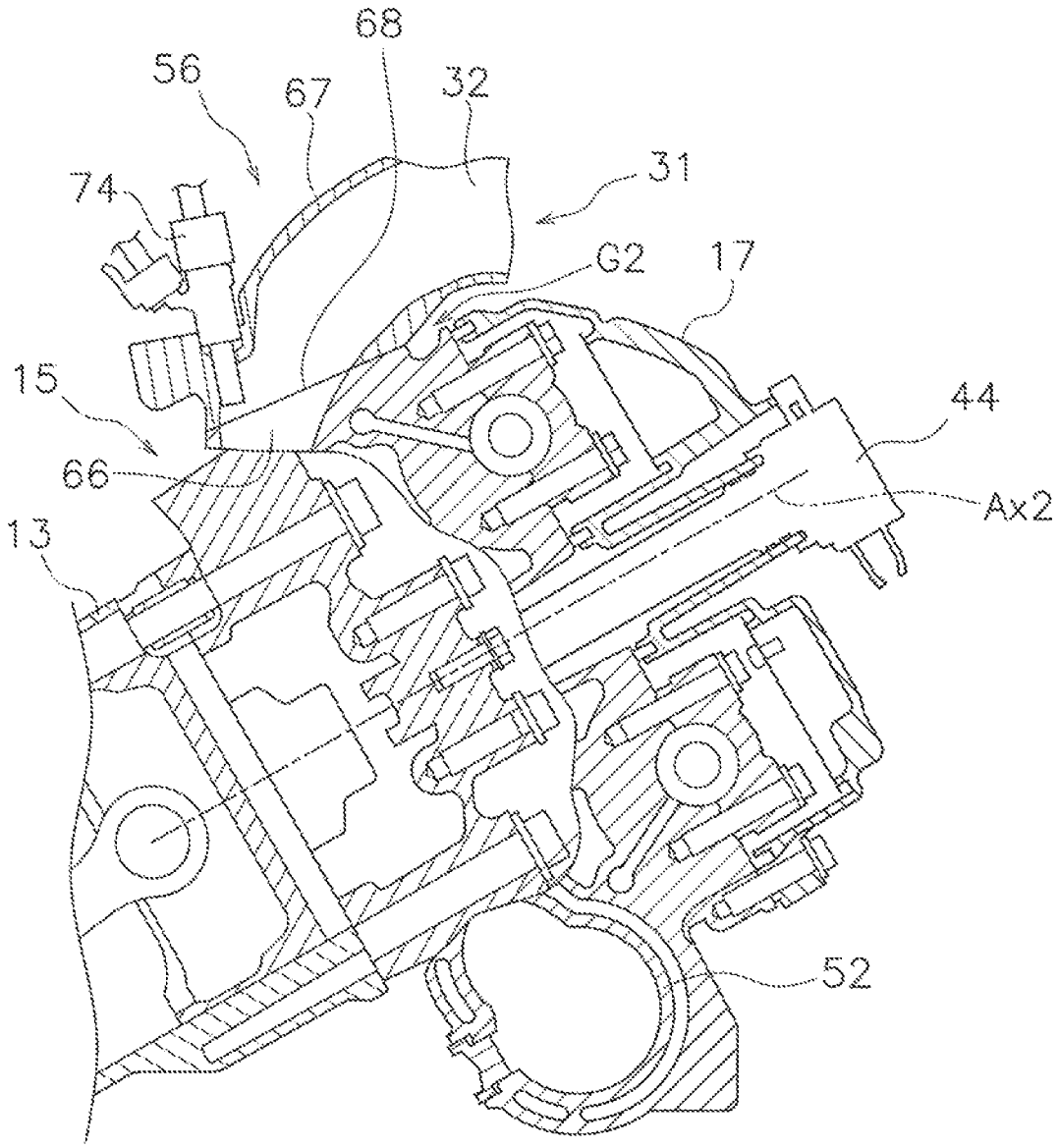
FIG. 12 is a cross-sectional view of a layout of injectors according to the embodiment of FIG. 11.

The layout of the left injectors and that of the right injectors are not limited to that of the aforementioned embodiment, and can be changed. For example, as shown in FIG. 11, the left injectors 71 to 73 can be attached, at the second pipe portion 64 of the left intake manifold 21, to the left curve pipe portion 55. In other words, the left injectors 71 to 73 can be attached to the left intake manifold 21. As shown in FIG. 12, the right injectors 74 to 76 can be attached, at the second pipe portion 67 of the right intake manifold 31, to the right curve pipe portion 56. In other words, the right injectors 74 to 76 can be attached to the right intake manifold 31.

Figure 13:
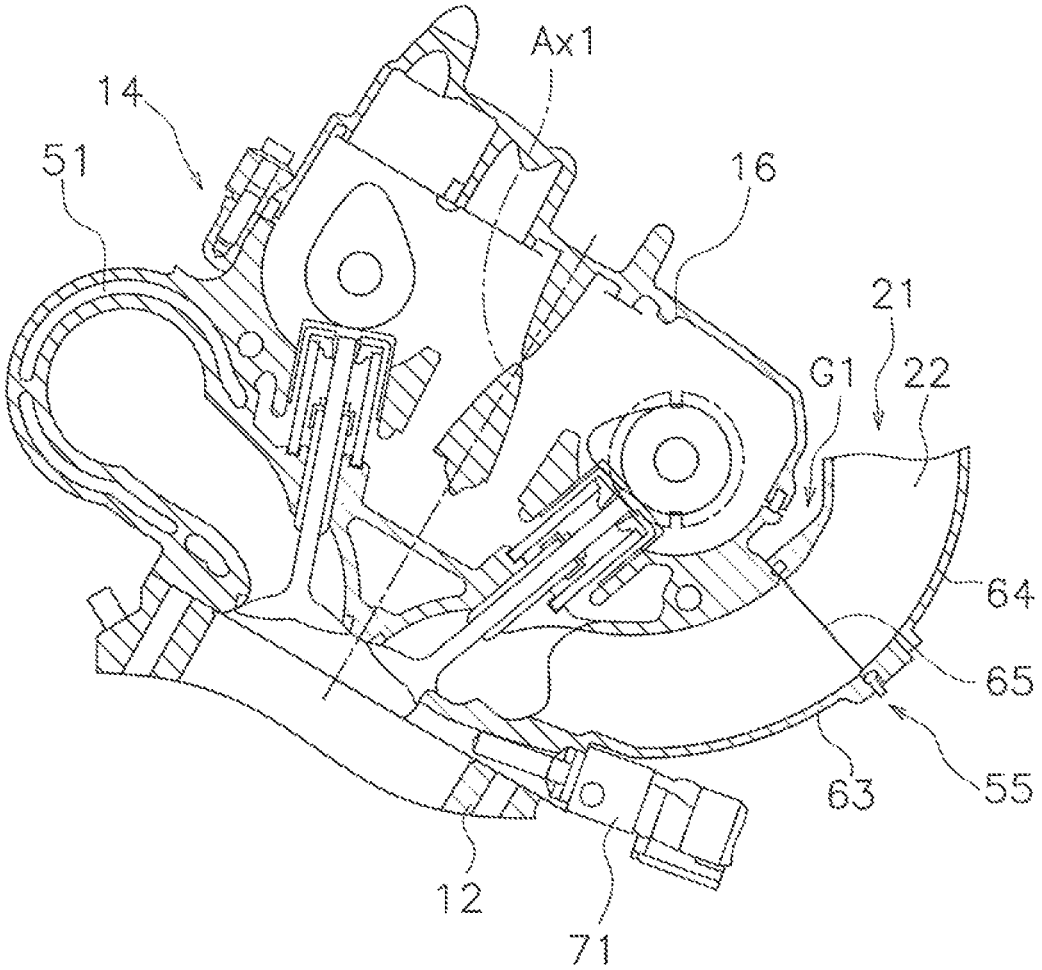
FIG. 13 is a cross-sectional view of a layout of the injectors according to yet another embodiment.
Figure 14:
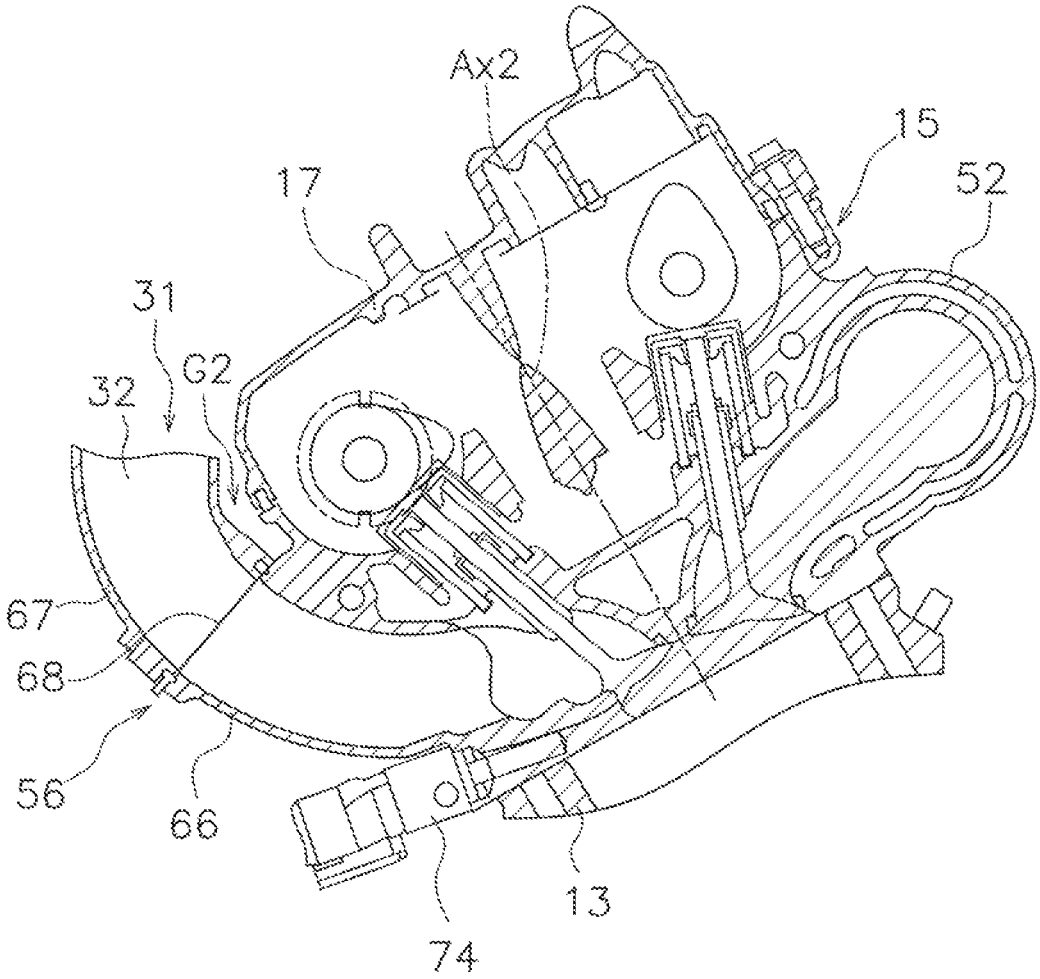
FIG. 14 is a cross-sectional view of a layout of the injectors according to the embodiment of FIG. 13.

The left injectors 71 to 73 can be attached to any suitable part other than the first pipe portion 63 of the left cylinder head 14. The right injectors 74 to 76 can be attached to any suitable part other than the first pipe portion 66 of right cylinder head 15. For example, as shown in FIG. 13, the left injectors 71 to 73 can be attached to the left cylinder head 14 in positions located forward of the left curve pipe portion 55. The left injectors 71 to 73 can be attached to inject the fuel into the combustion chamber of the left cylinder head 14. As shown in FIG. 14, the right injectors 74 to 76 can be attached to the right cylinder head 15 in positions located forward of the right curve pipe portion 56. The right injectors 74 to 76 can be attached to inject the fuel into the combustion chamber of the right cylinder head 15.

What is claimed is:

1. An outboard motor comprising:

an engine including a crankcase, a crankshaft and a cylinder head, the crankshaft being at least in part disposed inside the crankcase, the cylinder head being disposed backward relative to the crankcase with respect to a back-and-forth direction of the outboard motor;

a driveshaft connected to the crankshaft, the driveshaft extending in an up-and-down direction of the outboard motor;

a propeller shaft connected to the driveshaft, the propeller shaft extending in the back-and-forth direction of the outboard motor;

an intake manifold connected to the cylinder head, the intake manifold extending backward from the cylinder head in the back-and-forth direction of the outboard motor; and an injector attached to either the cylinder head or the intake manifold, at least one of the cylinder head and the intake manifold including a curve pipe portion, the curve pipe portion being shaped to curve backward from a lateral surface of the cylinder head, and the injector being attached to the cylinder head at either an outer lateral surface of the curve pipe portion in a right-and-left direction of the outboard motor or a position located forward of the curve pipe portion.

2. The outboard motor according to claim 1, wherein the injector is located inward of a lateral end of the intake manifold in the right-and-left direction of the outboard motor as seen in a plan view of the outboard motor.

3. The outboard motor according to claim 1, wherein the curve pipe portion includes a first pipe portion and a second pipe portion, the first pipe portion being included in the cylinder head, the second pipe portion being included in the intake manifold, and the injector is attached at the first pipe portion to the outer lateral surface of the curve pipe portion.

4. An outboard motor comprising:

an engine including a crankcase, a crankshaft and a cylinder head, the crankshaft being at least in part disposed inside the crankcase, the cylinder head being disposed behind the crankcase;

a driveshaft connected to the crankshaft, the driveshaft extending in an up-and-down direction of the outboard motor;

a propeller shaft connected to the driveshaft, the propeller shaft extending in a back-and-forth direction of the outboard motor;

an intake manifold connected to the cylinder head, the intake manifold extending backward from the cylinder head; and an injector attached to either the cylinder head or the intake manifold, at least one of the cylinder head and the intake manifold including a curve pipe portion, the curve pipe portion being shaped to curve backward from a lateral surface of the cylinder head, the injector being attached to the cylinder head at either an outer lateral surface of the curve pipe portion in a right-and-left direction of the outboard motor or a position located forward of the curve pipe portion, the curve pipe portion including a first pipe portion and a second pipe portion, the first pipe portion being included in the cylinder head, the second pipe portion being included in the intake manifold, the injector being attached at the first pipe portion to the outer lateral surface of the curve pipe portion, and the injector being located forward of a mating surface between the first pipe portion and the second pipe portion.

5. An outboard motor comprising:

an engine including a crankcase, a crankshaft and a cylinder head, the crankshaft being at least in part disposed inside the crankcase, the cylinder head being disposed behind the crankcase;

a driveshaft connected to the crankshaft, the driveshaft extending in an up-and-down direction of the outboard motor;

a propeller shaft connected to the driveshaft, the propeller shaft extending in a back-and-forth direction of the outboard motor;

an intake manifold connected to the cylinder head, the intake manifold extending backward from the cylinder head; and an injector attached to either the cylinder head or the intake manifold, at least one of the cylinder head and the intake manifold including a curve pipe portion, the curve pipe portion being shaped to curve backward from a lateral surface of the cylinder head, the injector being attached to the cylinder head at either an outer lateral surface of the curve pipe portion in a right-and-left direction of the outboard motor or a position located forward of the curve pipe portion, the cylinder head including a left cylinder head including a cylinder axis extending backward and leftward, and a right cylinder head including a cylinder axis extending backward and rightward, the intake manifold including a left intake manifold attached to the left cylinder head, and a right intake manifold attached to the right cylinder head, at least one of the left cylinder head and the left intake manifold including a left curve pipe portion, the left curve pipe portion being shaped to curve backward from a left lateral surface of the left cylinder head, at least one of the right cylinder head and the right intake manifold including a right curve pipe portion, the right curve pipe portion being shaped to curve backward from a right lateral surface of the right cylinder head, and the injector including a left injector attached to a left lateral surface of the left curve pipe portion in the right-and-left direction of the outboard motor, and a right injector attached to a right lateral surface of the right curve pipe portion in the right-and-left direction of the outboard motor.

6. The outboard motor according to claim 1, wherein the intake manifold includes a front end portion that is connected to the cylinder head, a rear end portion that is disposed backward relative to the cylinder head with respect to the back-and-forth direction of the outboard motor, and an intermediate portion extending between the front end portion and the rear end portion.

* * * * *